US006435651B1

(12) United States Patent
Otsuki et al.

(10) Patent No.: US 6,435,651 B1
(45) Date of Patent: Aug. 20, 2002

(54) PRINT PROCESSING FOR PERFORMING SUB-SCANNING COMBINING A PLURALITY OF FEED AMOUNTS

(75) Inventors: Koichi Otsuki; Kazushige Tayuki, both of Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/806,498

(22) PCT Filed: Aug. 11, 2000

(86) PCT No.: PCT/JP00/05426

§ 371 (c)(1),
(2), (4) Date: Apr. 13, 2001

(87) PCT Pub. No.: WO01/12441

PCT Pub. Date: Feb. 22, 2001

(30) Foreign Application Priority Data

Aug. 13, 1999 (JP) ..... 11-229252
Apr. 25, 2000 (JP) ..... 2000-124369

(51) Int. Cl.[7] ..... B41J 2/15
(52) U.S. Cl. ..... 347/41; 347/43
(58) Field of Search ..... 347/41, 40, 12, 347/15, 43, 9, 14, 16; 358/502, 1.9

(56) References Cited

U.S. PATENT DOCUMENTS 4,198,642 A 4/1980 Gamblin ..... 347/41
6,217,149 B1 * 4/2001 Takagi et al. ..... 347/41
6,250,734 B1 * 6/2001 Otsuki ..... 347/41
6,302,517 B1 * 10/2001 Kanaya ..... 347/41

FOREIGN PATENT DOCUMENTS

| | | |
|---|---|---|
| EP | 917955 | 5/1999 |
| EP | 931669 | 7/1999 |
| JP | 7-52465 | 2/1995 |
| JP | 10-278247 | 10/1998 |

* cited by examiner

*Primary Examiner*—Lamson D. Nguyen
(74) *Attorney, Agent, or Firm*—Oblon, Spivak, McClelland, Maier & Neustadt, P.C.

(57) ABSTRACT

Printing is carried out on a printing medium during main scanning using a printing device which comprises a print head having one or more nozzle arrays each including a plurality of nozzles for forming dots of same color. The plurality of nozzles for forming dots of the same color have a constant nozzle pitch k×D in the sub-scan direction, where k is an integer of 2 or greater and D is a dot pitch that corresponds to a printing resolution in the sub-scan direction. Each main scan line is scanned S times, where S is an integer of 2 or greater, using different nozzles. A combination of different values is used as feed amounts for S×k sub-scans. When the feed amounts for the S×k sub-scans are divided into S groups each containing k feed amounts for consecutive k sub-scans, a sequence of sub-scan feed amounts in at least one of the S groups of sub-scans is different from sequences in the other groups.

18 Claims, 18 Drawing Sheets

NOZZLE PITCH: k=6 [dots]
NUMBER OF WORKING NOZZLES: N=48
SCAN REPEAT: S=2 (OVERLAP MODE)
EFFECTIVE NOZZLE NUMBER: Neff=24

| PASS NUMBER | 1 | 2 | 3 | 4 | 5 | 6 | 7 | 8 | 9 | 10 | 11 | 12 | 13 |
|---|---|---|---|---|---|---|---|---|---|---|---|---|---|
| FEED AMOUNT L [dots] | 0 | 20 | 21 | 22 | 28 | 27 | 32 | 32 | 27 | 28 | 16 | 15 | 20 |
| Σ L | 0 | 20 | 41 | 63 | 91 | 118 | 150 | 182 | 209 | 237 | 253 | 268 | 288 |
| F=(Σ L)%k | 0 | 2 | 5 | 3 | 1 | 4 | 0 | 2 | 5 | 3 | 1 | 4 | 0 |
| RECORDING PIXEL | 0 | 1 | 0 | 1 | 0 | 1 | 1 | 0 | 1 | 0 | 1 | 0 | 0 |

RECORDING PIXEL "0": EVEN NUMBERED PIXEL POSITIONS
RECORDING PIXEL "1": ODD NUMBERED PIXEL POSITIONS

NOZZLE PITCH: k=3
WORKING NOZZLE NUMBER: N=4
SCAN REPEAT: S=1
EFFECTIVE NOZZLE NUMBER: Neff=4

| PASS NUMBER | 1 | 2 | 3 | 4 |
|---|---|---|---|---|
| FEED AMOUNT L [dots] | 0 | 4 | 4 | 4 |
| ΣL | 0 | 4 | 8 | 12 |
| F=(ΣL)%k | 0 | 1 | 2 | 0 |

NOZZLE PITCH: k=3
WORKING NOZZLE NUMBER: N=4
SCAN REPEAT: S=2
EFFECTIVE NOZZLE NUMBER: Neff=2

| PASS NUMBER | 1 | 2 | 3 | 4 | 5 | 6 | 7 |
|---|---|---|---|---|---|---|---|
| RECORDING PIXEL | 0 | 1 | 0 | 1 | 0 | 1 | 0 |
| FEED AMOUNT L [dots] | 0 | 2 | 2 | 2 | 2 | 2 | 2 |
| ΣL | 0 | 2 | 4 | 6 | 8 | 10 | 12 |
| F=(ΣL)%k | 0 | 2 | 1 | 0 | 2 | 1 | 0 |

RECORDING PIXEL "0": EVEN NUMBERED PIXEL POSITIONS
RECORDING PIXEL "1": ODD NUMBERED PIXEL POSITIONS

*Fig.6*

NOZZLE PITCH: k=6 [dots]
NUMBER OF WORKING NOZZLES: N=48
SCAN REPEAT: S=2 (OVERLAP MODE)
EFFECTIVE NOZZLE NUMBER: Neff=24

| PASS NUMBER | 1 | 2 | 3 | 4 | 5 | 6 | 7 | 8 | 9 | 10 | 11 | 12 | 13 |
|---|---|---|---|---|---|---|---|---|---|---|---|---|---|
| FEED AMOUNT L [dots] | 0 | 20 | 21 | 22 | 28 | 27 | 32 | 32 | 27 | 28 | 16 | 15 | 20 |
| $\Sigma L$ | 0 | 20 | 41 | 63 | 91 | 118 | 150 | 182 | 209 | 237 | 253 | 268 | 288 |
| $F=(\Sigma L)\%k$ | 0 | 2 | 5 | 3 | 1 | 4 | 0 | 2 | 5 | 3 | 1 | 4 | 0 |
| RECORDING PIXEL | 0 | 1 | 0 | 1 | 0 | 1 | 1 | 0 | 1 | 0 | 1 | 0 | 0 |

RECORDING PIXEL "0": EVEN NUMBERED PIXEL POSITIONS
RECORDING PIXEL "1": ODD NUMBERED PIXEL POSITIONS

| PASS NUMBER | 1 | 2 | 3 | 4 | 5 | 6 | 7 | 8 | 9 | 10 | 11 | 12 | 13 |
|---|---|---|---|---|---|---|---|---|---|---|---|---|---|
| FEED AMOUNT L [dots] | 0 | 20 | 21 | 22 | 28 | 27 | 32 | 32 | 27 | 28 | 16 | 15 | 20 |
| ΣL | 0 | 20 | 41 | 63 | 91 | 118 | 150 | 182 | 209 | 237 | 253 | 268 | 288 |
| F=(ΣL)%k | 0 | 2 | 5 | 3 | 1 | 4 | 0 | 2 | 5 | 3 | 1 | 4 | 0 |
| RECORDING PIXEL | 0 | 1 | 0 | 1 | 0 | 1 | 1 | 0 | 1 | 0 | 1 | 0 | 0 |

*Fig. 8*

NOZZLE PITCH: k=6 [dots]
NUMBER OF WORKING NOZZLES: N=48
SCAN REPEAT: S=2 (OVERLAP MODE)
EFFECTIVE NOZZLE NUMBER: Neff=24

| PASS NUMBER | 1 | 2 | 3 | 4 | 5 | 6 | 7 | 8 | 9 | 10 | 11 | 12 | 13 |
|---|---|---|---|---|---|---|---|---|---|---|---|---|---|
| FEED AMOUNT L [dots] | 0 | 26 | 27 | 16 | 16 | 27 | 32 | 26 | 27 | 16 | 16 | 27 | 32 |
| $\Sigma L$ | 0 | 26 | 53 | 69 | 85 | 112 | 144 | 170 | 197 | 213 | 229 | 256 | 288 |
| $F=(\Sigma L)\%k$ | 0 | 2 | 5 | 3 | 1 | 4 | 0 | 2 | 5 | 3 | 1 | 4 | 0 |
| RECORDING PIXEL | 0 | 1 | 0 | 1 | 0 | 1 | 1 | 0 | 1 | 0 | 1 | 0 | 0 |

RECORDING PIXEL "0": EVEN NUMBERED PIXEL POSITIONS
RECORDING PIXEL "1": ODD NUMBERED PIXEL POSITIONS

| PASS NUMBER | 1 | 2 | 3 | 4 | 5 | 6 | 7 | 8 | 9 | 10 | 11 | 12 | 13 |
|---|---|---|---|---|---|---|---|---|---|---|---|---|---|
| FEED AMOUNT L [dots] | 0 | 26 | 27 | 16 | 16 | 27 | 32 | 26 | 27 | 16 | 16 | 27 | 32 |
| Σ L | 0 | 26 | 53 | 69 | 85 | 112 | 144 | 170 | 197 | 213 | 229 | 256 | 288 |
| F=(Σ L)%k | 0 | 2 | 5 | 3 | 1 | 4 | 0 | 2 | 5 | 3 | 1 | 4 | 0 |
| RECORDING PIXEL | 0 | 1 | 0 | 1 | 0 | 1 | 1 | 0 | 1 | 0 | 1 | 0 | 0 |

Fig.10(A)

| | | | | | | | | | | | | |
|---|---|---|---|---|---|---|---|---|---|---|---|---|
| UPPER-ADJACENT RASTER LINE RECORDING NOZZLE | 29 | 36 | 37 | 39 | 14 | 29 | 19 | 35 | 37 | 43 | 39 | 37 |
| PARTNER NOZZLE | 20 | 21 | 22 | 22 | 24 | 24 | 26 | 26 | 28 | 28 | 29 | 30 |
| LOWER-ADJACENT RASTER LINE RECORDING NOZZLE | 15 | 31 | 13 | 13 | 7 | 14 | 11 | 11 | 21 | 13 | 36 | 21 |

(8 PARTNER NOZZLES)

Fig.10(B)

| | | | | | | | |
|---|---|---|---|---|---|---|---|
| UPPER-ADJACENT RASTER LINE RECORDING NOZZLE | 16 | 32 | 32 | 32 | 39 | 39 | 39 |
| PARTNER NOZZLE | 25 | 25 | 25 | 25 | 25 | 25 | 25 |
| LOWER-ADJACENT RASTER LINE RECORDING NOZZLE | 11 | 18 | 11 | 18 | 11 | 18 | 34 |

(1 PARTNER NOZZLE)

*Fig.11(A)*

| PASS NUMBER | 1 | 2 | 3 | 4 | 5 | 6 | 7 | 8 | 9 | 10 | 11 | 12 | 13 |
|---|---|---|---|---|---|---|---|---|---|---|---|---|---|
| FEED AMOUNT L [dots] | 0 | 20 | 21 | 22 | 28 | 27 | 32 | 32 | 27 | 16 | 28 | 15 | 20 |
| ΣL | 0 | 20 | 41 | 63 | 91 | 118 | 150 | 182 | 209 | 225 | 253 | 268 | 288 |
| F=(ΣL)%k | 0 | 2 | 5 | 3 | 1 | 4 | 0 | 2 | 5 | 3 | 1 | 4 | 0 |
| RECORDING PIXEL | 0 | 1 | 0 | 1 | 0 | 1 | 1 | 0 | 1 | 0 | 1 | 0 | 0 |

*Fig.11(B)*

| PASS NUMBER | 1 | 2 | 3 | 4 | 5 | 6 | 7 | 8 | 9 | 10 | 11 | 12 | 13 |
|---|---|---|---|---|---|---|---|---|---|---|---|---|---|
| FEED AMOUNT L [dots] | 0 | 20 | 21 | 22 | 28 | 27 | 32 | 26 | 27 | 28 | 22 | 21 | 14 |
| ΣL | 0 | 20 | 41 | 63 | 91 | 118 | 150 | 176 | 203 | 231 | 253 | 274 | 288 |
| F=(ΣL)%k | 0 | 2 | 5 | 3 | 1 | 4 | 0 | 2 | 5 | 3 | 1 | 4 | 0 |
| RECORDING PIXEL | 0 | 1 | 0 | 1 | 0 | 1 | 1 | 0 | 1 | 0 | 1 | 0 | 0 |

*Fig.11(C)*

| PASS NUMBER | 1 | 2 | 3 | 4 | 5 | 6 | 7 | 8 | 9 | 10 | 11 | 12 | 13 |
|---|---|---|---|---|---|---|---|---|---|---|---|---|---|
| FEED AMOUNT L [dots] | 0 | 26 | 15 | 28 | 22 | 33 | 32 | 20 | 33 | 22 | 28 | 15 | 14 |
| ΣL | 0 | 26 | 41 | 69 | 91 | 124 | 156 | 176 | 209 | 231 | 259 | 274 | 288 |
| F=(ΣL)%k | 0 | 2 | 5 | 3 | 1 | 4 | 0 | 2 | 5 | 3 | 1 | 4 | 0 |
| RECORDING PIXEL | 0 | 1 | 0 | 1 | 0 | 1 | 1 | 0 | 1 | 0 | 1 | 0 | 0 |

NOZZLE PITCH: k=6 [dots]
NUMBER OF WORKING NOZZLES: N=48
SCAN REPEAT: S=2
EFFECTIVE NOZZLE NUMBER: Neff=24

RECORDING PIXEL "0": EVEN NUMBERED PIXEL POSITIONS
RECORDING PIXEL "1": ODD NUMBERED PIXEL POSITIONS

Fig. 12(A)

| | | | | | | | | | | | | |
|---|---|---|---|---|---|---|---|---|---|---|---|---|
| UPPER-ADJACENT RASTER LINE RECORDING NOZZLE | 36 | 29 | 37 | 39 | 14 | 31 | 19 | 35 | 35 | 37 | 43 | 39 |
| PARTNER NOZZLE | 21 | 22 | 22 | 22 | 24 | 24 | 26 | 26 | 28 | 28 | 28 | 29 |
| LOWER-ADJACENT RASTER LINE RECORDING NOZZLE | 31 | 15 | 15 | 13 | 7 | 14 | 11 | 11 | 19 | 21 | 13 | 36 |

(6 PARTNER NOZZLES)

Fig. 12(B)

| | | | | | | | | | | | | |
|---|---|---|---|---|---|---|---|---|---|---|---|---|
| UPPER-ADJACENT RASTER LINE RECORDING NOZZLE | 30 | 36 | 39 | 30 | 37 | 15 | 19 | 36 | 36 | 37 | 43 | 36 |
| PARTNER NOZZLE | 21 | 22 | 22 | 23 | 23 | 24 | 26 | 27 | 27 | 28 | 28 | 29 |
| LOWER-ADJACENT RASTER LINE RECORDING NOZZLE | 14 | 31 | 13 | 14 | 14 | 7 | 11 | 13 | 20 | 35 | 14 | 20 |

(8 PARTNER NOZZLES)

Fig. 12(C)

| | | | | | | | | | | | | |
|---|---|---|---|---|---|---|---|---|---|---|---|---|
| UPPER-ADJACENT RASTER LINE RECORDING NOZZLE | 35 | 38 | 31 | 14 | 31 | 38 | 35 | 35 | 20 | 35 | 38 | 44 |
| PARTNER NOZZLE | 21 | 21 | 22 | 23 | 24 | 24 | 26 | 26 | 27 | 28 | 29 | 29 |
| LOWER-ADJACENT RASTER LINE RECORDING NOZZLE | 30 | 12 | 15 | 6 | 15 | 15 | 12 | 19 | 12 | 19 | 36 | 15 |

(8 PARTNER NOZZLES)

*Fig. 13*

NOZZLE PITCH: k=6 [dots]
NUMBER OF WORKING NOZZLES: N=48
SCAN REPEAT: S=2 (OVERLAP MODE)
EFFECTIVE NOZZLE NUMBER: Neff=24

| PASS NUMBER | 1 | 2 | 3 | 4 | 5 | 6 | 7 | 8 | 9 | 10 | 11 | 12 | 13 |
|---|---|---|---|---|---|---|---|---|---|---|---|---|---|
| FEED AMOUNT L [DOTS] | 0 | 8 | 9 | 10 | 22 | 33 | 62 | 20 | 45 | 34 | 10 | 15 | 20 |
| $\Sigma L$ | 0 | 8 | 17 | 27 | 49 | 82 | 144 | 164 | 209 | 243 | 253 | 268 | 288 |
| $F=(\Sigma L)\%k$ | 0 | 2 | 5 | 3 | 1 | 4 | 0 | 2 | 5 | 3 | 1 | 4 | 0 |
| RECORDING PIXEL | 0 | 1 | 0 | 1 | 0 | 1 | 1 | 0 | 1 | 0 | 1 | 0 | 0 |

RECORDING PIXEL "0": EVEN NUMBERED PIXEL POSITIONS
RECORDING PIXEL "1": ODD NUMBERED PIXEL POSITIONS

Fig. 14

| | | | | | | | | | | | | |
|---|---|---|---|---|---|---|---|---|---|---|---|---|
| UPPER ADJACENT RASTER RECORDING NOZZLE | 26 | 33 | 38 | 22 | 42 | 14 | 22 | 34 | 41 | 39 | 43 | 40 |
| PARTNER NOZZLE | 13 | 15 | 17 | 18 | 23 | 25 | 25 | 27 | 32 | 33 | 35 | 37 |
| LOWER ADJACENT RASTER RECORDING NOZZLE | 9 | 8 | 28 | 12 | 10 | 7 | 17 | 24 | 11 | 36 | 16 | 28 |

(11 PARTNER NOZZLES)

NOZZLE PITCH: k=4 [dots]
NUMBER OF WORKING NOZZLES: N=48
SCAN REPEAT: S=2 (OVERLAP MODE)
EFFECTIVE NOZZLE NUMBER: Neff=24

| PASS NUMBER | 1 | 2 | 3 | 4 | 5 | 6 | 7 | 8 | 9 |
|---|---|---|---|---|---|---|---|---|---|
| FEED AMOUNT L [dots] | 0 | 24 | 25 | 25 | 25 | 24 | 23 | 23 | 23 |
| $\Sigma L$ | 0 | 24 | 49 | 74 | 99 | 123 | 146 | 169 | 192 |
| $F=(\Sigma L)\%k$ | 0 | 0 | 1 | 2 | 3 | 3 | 2 | 1 | 0 |
| RECORDING PIXEL | 0 | 1 | 1 | 0 | 0 | 1 | 1 | 0 | 0 |

RECORDING PIXEL "0": EVEN NUMBERED PIXEL POSITIONS
RECORDING PIXEL "1": ODD NUMBERED PIXEL POSITIONS

| PASS NUMBER | 1 | 2 | 3 | 4 | 5 | 6 | 7 | 8 | 9 |
|---|---|---|---|---|---|---|---|---|---|
| FEED AMOUNT L [dots] | 0 | 24 | 25 | 25 | 25 | 24 | 23 | 23 | 23 |
| ΣL | 0 | 24 | 49 | 74 | 99 | 123 | 146 | 169 | 192 |
| F=(ΣL)%k | 0 | 0 | 1 | 2 | 3 | 3 | 2 | 1 | 0 |
| RECORDING PIXEL | 0 | 1 | 1 | 0 | 0 | 1 | 1 | 0 | 0 |

NOZZLE PITCH: k=4 [dots]
NUMBER OF WORKING NOZZLES: N=48
SCAN REPEAT: S=2 (OVERLAP MODE)
EFFECTIVE NOZZLE NUMBER: Neff=24

| PASS NUMBER | 1 | 2 | 3 | 4 | 5 | 6 | 7 | 8 | 9 |
|---|---|---|---|---|---|---|---|---|---|
| FEED AMOUNT L [dots] | 0 | 24 | 26 | 23 | 26 | 24 | 22 | 25 | 22 |
| $\Sigma L$ | 0 | 24 | 50 | 73 | 99 | 123 | 145 | 170 | 192 |
| $F=(\Sigma L)\%k$ | 0 | 0 | 2 | 1 | 3 | 3 | 1 | 2 | 0 |
| RECORDING PIXEL | 0 | 1 | 1 | 0 | 0 | 1 | 1 | 0 | 0 |

RECORDING PIXEL "0": EVEN NUMBERED PIXEL POSITIONS
RECORDING PIXEL "1": ODD NUMBERED PIXEL POSITIONS

| PASS NUMBER | 1 | 2 | 3 | 4 | 5 | 6 | 7 | 8 | 9 |
|---|---|---|---|---|---|---|---|---|---|
| FEED AMOUNT L [dots] | 0 | 24 | 26 | 23 | 26 | 24 | 22 | 25 | 22 |
| ΣL | 0 | 24 | 50 | 73 | 99 | 123 | 145 | 170 | 192 |
| F=(ΣL)%k | 0 | 0 | 2 | 1 | 3 | 3 | 1 | 2 | 0 |
| RECORDING PIXEL | 0 | 1 | 1 | 0 | 0 | 1 | 1 | 0 | 0 |

PRINT PROCESSING FOR PERFORMING SUB-SCANNING COMBINING A PLURALITY OF FEED AMOUNTS

TECHNICAL FIELD

The present invention relates to a printing technology using a print head having multiple nozzles.

BACKGROUND ART

In recent years, ink jet printers that discharge ink from a head are widely used as computer output devices. Ink jet printers employ a print head having multiple nozzles for each ink.

One printing mode is established whereby sub-scan feed amounts and the number of nozzles used is controlled during printing with the printer. In such cases, there is some constraint in terms of sub-scanning feed amounts and number of nozzles used in order to perform recording at pixel positions on the printing medium without unnecessary duplications or omissions.

In this connection, it is desirable that as many of the mounted nozzles as possible are used in the execution of printing in order to improve printing speed. Towards this end, numerous different values for the sub-scan feed amount are used in combination in the technology described in JP-A-1998-278247 disclosed by the applicant of this application. In addition, this document also describes an "overlap mode" in which recording of each main scan line is completed in two or more main scans. With overlap mode in which recording on each main scan line is completed in two main scans, the respective main scan lines are each scanned with two different nozzles.

However, with previous overlap mode, there has been the problem that there are restricted combinations of nozzles that carry out recording of a single main scan line. For example, main scan lines that are recorded using nozzle #1 are always recorded with nozzle #25, and main scan lines that are recorded using nozzle #2 are always recorded with nozzle #26. The number of nozzle combinations is thus restricted to one.

Because the number of combinations of nozzles used for recording a single main scan line is restricted to one, striated regions of image quality degradation referred to as "banding" appears in the main scan lines. For example, due to manufacture differences in nozzles #1 and #25 that perform recording of the same main scan line, there are cases where dots are recorded at shifted positions in the same direction along the sub-scanning direction relative to the theoretical position (intended position). In such cases, a gap (specifically, banding) arises between a main scan line and its adjacent main scan line, resulting in image degradation.

This invention was developed in order to solve the above problems with conventional technologies, and has an object of offering a technology for mitigating image degradation in overlap mode.

DISCLOSURE OF THE INVENTION

In order to solve at least some of the problems described above, the present invention carries out printing on a printing medium during main scanning using a printing device which comprises a print head having one or more nozzle arrays each including a plurality of nozzles for forming dots of same color. The plurality of nozzles for forming dots of the same color have a constant nozzle pitch k×D in the sub-scan direction, where k is an integer of 2or greater and D is a dot pitch that corresponds to a printing resolution in the sub-scan direction. Each main scan line is scanned S times, where S is an integer of 2 or greater, using different nozzles. A combination of different values is used as feed amounts for S×k sub-scans. When the feed amounts for the S×k sub-scans are divided into S groups each containing k feed amounts for consecutive k sub-scans, a sequence of sub-scan feed amounts in at least one of the S groups of sub-scans is different from sequences in the other groups.

In the present invention, because the sequences of the S groups of sub-scan feed amounts are not the same, combinations of nozzles for recording the same main scan line are not fixed to only one, and multiple combinations are used. This results in reduction of banding and mitigation of image quality degradation.

It is preferable that intermittent pixel positions at a ratio of 1 to S pixels on a main scan line are serviced for dot formation in each of S main scans performed on the main scan line, and all of the pixel positions on the main scan line are serviced for dot formation by the S main scans.

In this case, the banding caused by the configuration where the combinations of nozzles for recording the same main scan line are fixed to only one tends to be particularly noticeable. Consequently, the aforementioned effect is particularly remarkable in such cases.

It is preferable that a ratio of the largest and smallest values of the S×k sub-scan feed amounts is set at about 4 or greater.

In this configuration, even if banding should occur for whatever reason, the banding occurrence period varies with the value of the sub-scan feed amount, and so banding is not readily seen. The image quality degradation is further reduced consequently.

When a offset F is defined as a remainder obtained by dividing a cumulative value of sub-scan feed amounts by the integer k, a sequence of the offset F for at least one of the S groups of sub-scan feed amounts may be different from sequences for the other groups.

The offset F sequence is related very strongly to cumulative error occurring in the sub-scan feed, and using different offset F sequences tends to decrease cumulative error in the sub-scan feed, allowing mitigation of banding.

It is preferable that the sequence of the offset F for each group of sub-scan feed amounts is reversed from the sequence of the offset F for adjacent groups.

In this configuration, it is possible to additionally decrease the cumulative error in the sub-scan feed, thus making it possible to additionally reducing banding.

The effect of the above configuration related to the offset F sequence is particularly remarkable when dots are formed with a print head using pigment ink.

The present invention can be realized in various configurations, such as a printing device and printing method, a computer program for implementing the functions of the device or method, a computer readable recording medium storing the computer program, and a data signal embodied in a carrier wave that includes the computer program.

BRIEF DESCRIPTION OF THE DRAWINGS

FIG. 6 is an explanatory diagram showing the scanning parameters of the first embodiment.

FIG. 8 is an explanatory diagram showing the scanning parameters for a comparative example.

FIGS. 10A and 10(B) are explanatory diagrams showing partner nozzles of nozzle #1 and nozzles for recording adjacent raster lines above and below, pertaining to the first embodiment and the comparative example respectively.

FIGS. 11(A)–11(C) are explanatory diagrams showing the scanning parameter of the second through fourth embodiments.

FIGS. 12(A)–12(C) are explanatory diagrams showing partner nozzles of nozzle #1 and nozzles for recording adjacent raster lines above and below, pertaining to the second through fourth embodiments and the comparative example respectively.

FIG. 13 is an explanatory diagram showing the scanning parameters for the fifth embodiment.

FIG. 14 is an explanatory diagram showing partner nozzles of nozzle #1 and nozzles for recording adjacent raster lines above and below, pertaining to the fifth embodiment.

BEST MODE FOR CARRYING OUT THE INVENTION

Modes of implementation of the present invention are described below based on embodiments in the following order.

A. General structure of the device

B. Basic conditions for general recording mode

C. Recording mode examples in the embodiments

D. Modifications

A. General Structure of the Device

Figure 1:
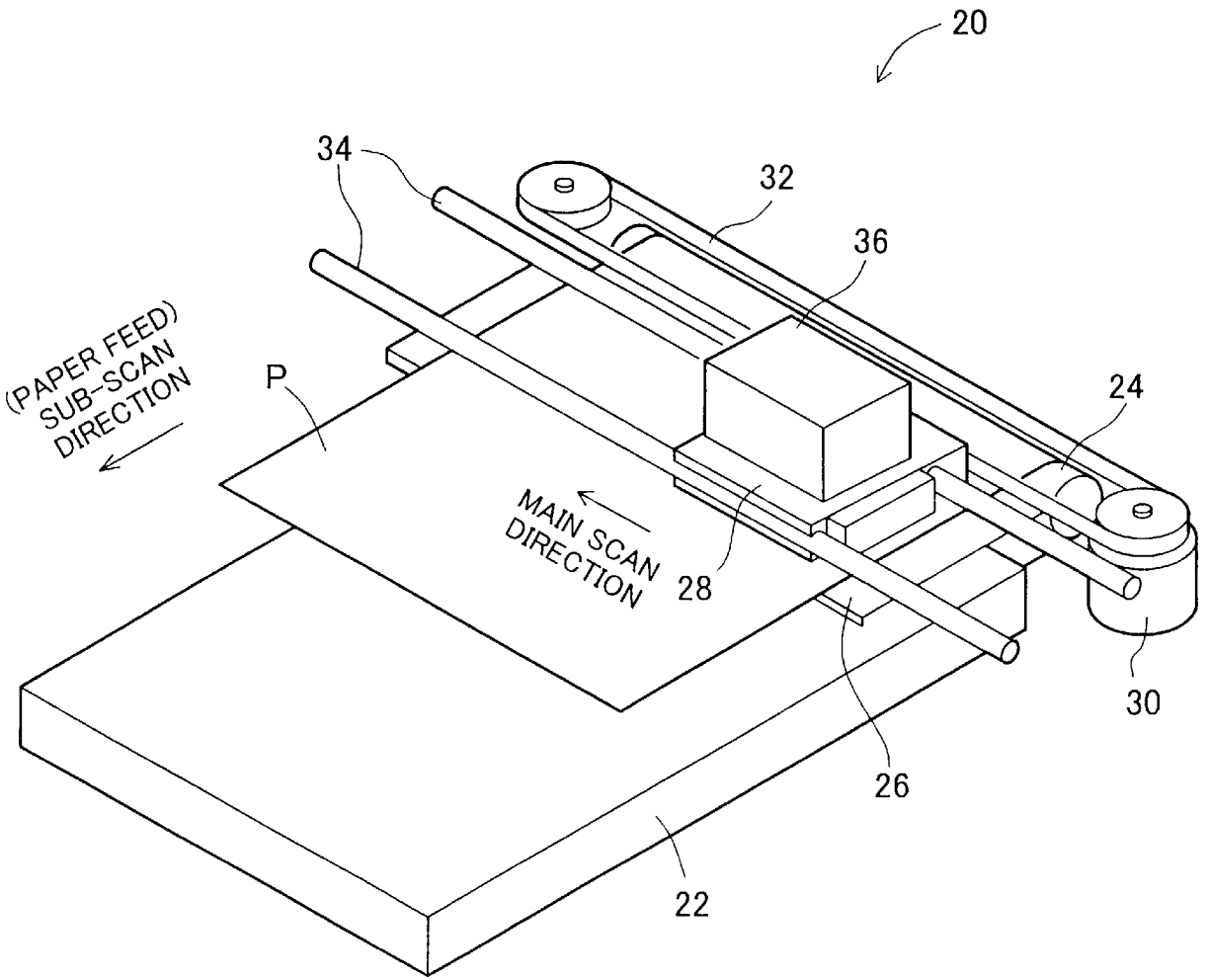
FIG. 1 is a general oblique view showing the main structure of a color ink jet printer 20 used as an embodiment of the present invention.

FIG. 1 is a general oblique view showing the main structure of a color ink jet printer 20 used as a embodiment of the present invention. This printer 20 is equipped with a paper stacker 22, a paper feed roll 24 that is driven by a step motor not shown, a platen 26, a carriage 28, a step motor 30, a ribbed belt 32 that is driven by this step motor 30, and a guide rail 34 for the carriage 28. A print head 36 equipped with numerous nozzles is mounted on this carriage 28.

The printing paper P is taken up onto a paper feed roller 24 from the paper stacker 22, and is transported in the sub-scan direction on the surface of the platen 26. The carriage 28 is pulled by a pulling belt 32 that is driven by the step motor 30, and is thus moved in the main scan direction along the guide rail 34. The main scan direction is perpendicular to the sub-scan direction.

Figure 2:
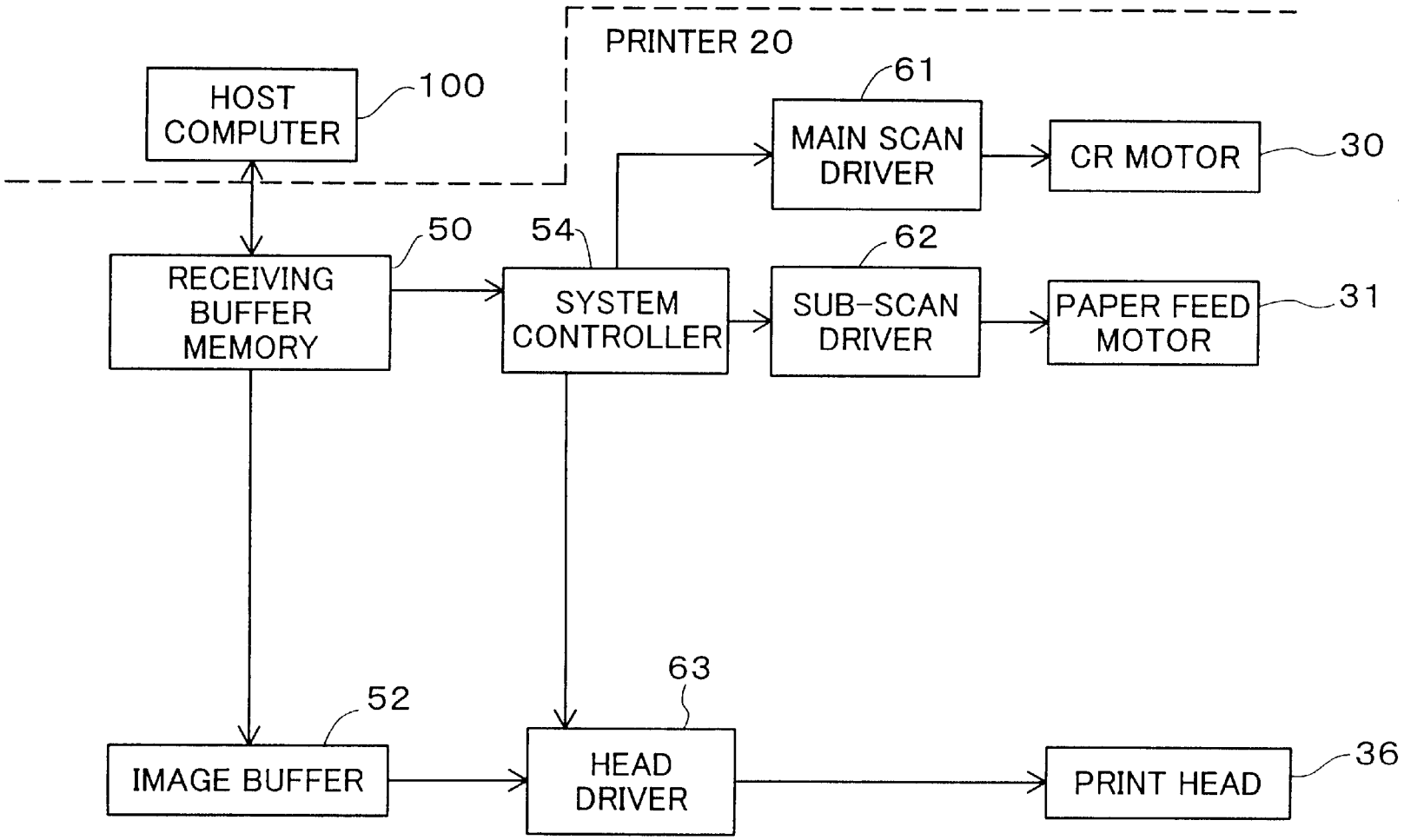
FIG. 2 is a block diagram showing the electrical configuration of the printer 20.

FIG. 2 is a block diagram showing the electrical configuration of the printer 20. The printer 20 is equipped with a receiving buffer memory 50 for receiving signals supplied from the host computer 100, an image buffer 52 that stores printing data, and a system controller 54 that controls operation of the entire printer 20. The system controller 54 are coupled to a main scan driver 61 that drives the carriage motor 30, a sub-scan driver 62 that drives the paper feed motor 31, and a head driver 63 that drives the print head 36.

The printer driver (not shown) of the host computer 100 sets various parameter values that control printing operations based on the recording mode that has been specified by the user (described below). This printer driver also generates printing data for performing printing according to this recording mode based on these parameter values, and the data is transferred to the printer 20. The printing data thus transferred is temporarily stored in the receiving buffer memory 50. The system controller 54 in the printer 20 reads the required data from the printing data in the receiving buffer memory 50, and control signals are sent to respective drivers 61, 62 and 63 based on this data.

The printing data received by the receiving buffer memory 50 is then divided into each color component and the image data of the various resulting color components is stored in the image buffer 52. The head driver 63 reads the image data for each color component from the image buffer 52 in accordance with the control signals from the system controller 54, and the nozzle array for each color situated on the print head 36 is driven in accordance therewith. The head driver 63 can generate numerous different types of drive signal waveforms. The internal configuration and functioning of the head driver 63 will be described later in detail.

Figure 3:
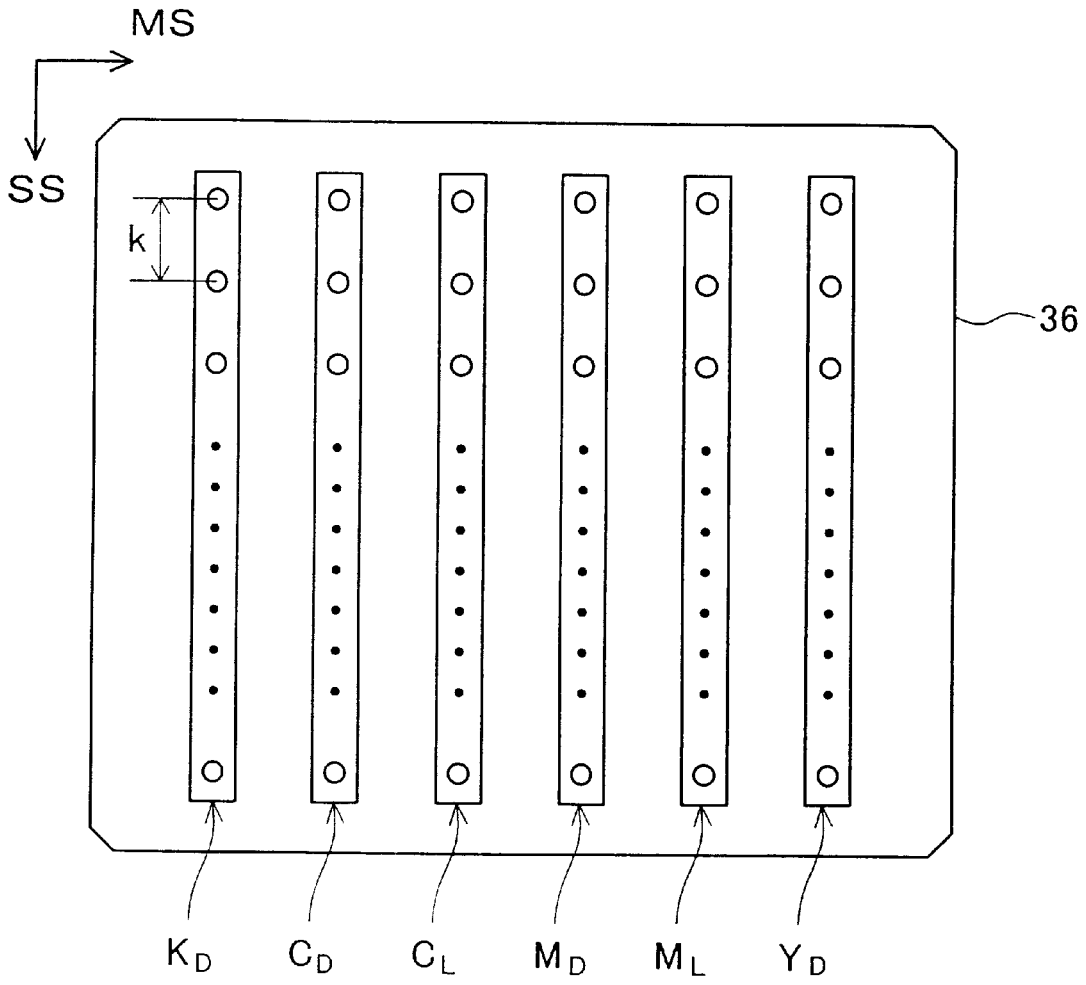
FIG. 3 is an explanatory diagram showing the nozzle array on the bottom surface of the print head 36.

FIG. 3 is an explanatory diagram showing the nozzle array provided on the lower surface of the print head 36. There are provided, on the bottom surface of the head 36, black ink nozzle group $K_D$ for discharging black ink, dark cyan ink nozzle group $C_D$ for discharging dark cyan ink, light cyan ink nozzle group $C_L$ for discharging light cyan ink, dark magenta ink nozzle group $M_D$ for discharging dark magenta ink, light magenta ink nozzle group $M_L$ for discharging light magenta ink, and yellow ink nozzle group $Y_D$ for discharging yellow ink.

The first large upper case letter in the designations of the nozzle groups designate the ink color, and the suffix "D" denotes ink with comparatively high density, whereas the suffix "L" denotes ink of comparatively low density.

The numerous nozzles of each nozzle group are arranged with a constant nozzle pitch k along the sub-scan direction SS. The nozzle pitch k is set to a value that is an integral multiple of the print resolution (referred to as "dot pitch"). In addition, piezo-electric elements (not shown in FIGS. ) are provided as drive elements that drive each of the nozzles, thereby causing discharge of ink droplets. During printing, the print head 36 travels along the main scan direction MS along with the carriage 28 (FIG. 1), and as this occurs, ink droplets are discharged from each nozzle.

B. Basic Conditions for General Recording Mode

Before presenting a detailed description of the recording mode used in the embodiments of the present invention, the basic parameters used in ordinary recording mode will be described. In this specification, the terms "recording mode" and "printing mode" are synonymous.

Figures 4A, 4B:
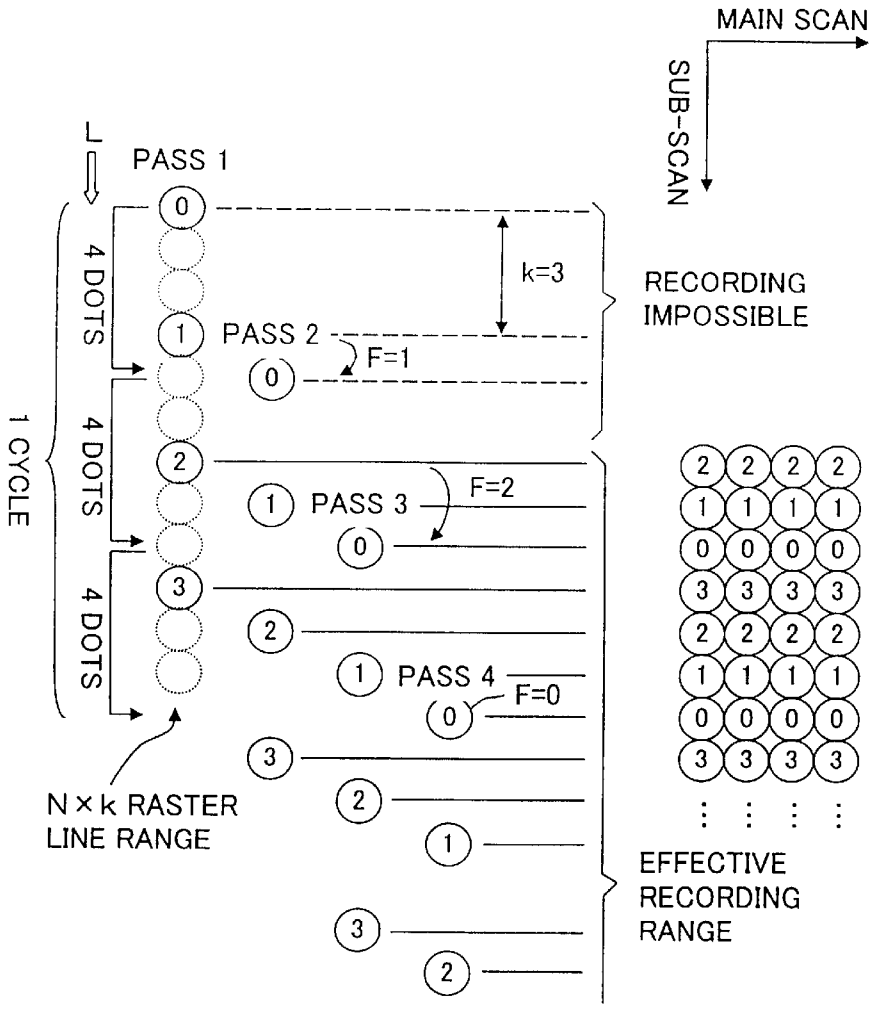
FIGS. 4(A) and 4(B) are explanatory diagrams showing the basic conditions for general dot recording mode.

FIGS. 4(A) and 4(B) are explanatory diagrams showing the basic parameters for ordinary dot printing modes. FIG. 4(A) shows an example of the sub-scan feeding when four nozzles are used, and FIG. 4(B) shows the parameters for the recording mode thereof. In FIG. 4(A), the solid circles enclosing the numbers denote the positions of the four nozzles in the sub-scan direction on each pass. The term "pass" refers to a single main scan. The numerals 0–3 enclosed in circles denote the nozzle numbers. The positions of the four nozzles move in the sub-scan direction after completion of a single main scan. Actually, feeding in the sub-scan direction is achieved by movement of the paper carried out by the paper feed motor 31 (FIG. 2).

As indicated at the left side of FIG. 4(A), the sub-scan feed amount L in this example is a constant value of four dots. Consequently, when sub-scan feeding occurs, the positions of the four nozzles shift four dots in the sub-scan direction. All of the dot positions (also referred to as "pixel positions" ) on each of the raster lines in a single main scan is serviced by the nozzle. In this specification, the number of main scans occurring on each raster line (referred to also as "main scan line" ) is referred to as the "scan repeat number S".

At the right side of FIG. 4(A), the numbers of the nozzles that record dots on each raster line are indicated. Actual dot recording is prohibited on the raster lines that are drawn by broken lines extending to the right in the main scan direction from the circle indicating nozzle positions in the sub-scan direction because at least one of the previous and subsequent raster lines cannot be recorded. On the other hand, the raster lines that are drawn by solid lines extending in the main scan direction are in regions where the previous and subsequent raster lines can be recorded with dots. The region where actual recording is carried out in this manner is referred to as the effective recording region below (also referred to as "effective printing region", "printing execution region" and "recording execution region").

In FIG. 4(B), each of the parameters related to this dot recording mode are shown. The dot recording mode parameters includes a nozzle pitch k [dots], a working nozzle number N, a scan repeat number S, an effective nozzle number Neff, and sub-scan feed amounts L [dots].

In the example of FIGS. 4(A) and 4(B), the nozzle pitch k is 3 dots, and the working nozzle number N is 4. The working nozzle number N is the number of nozzles actually used among the multiple nozzles mounted. The scan repeat number S refers to the number of repetitions of main scans on each raster line. For example, when the scan repeat number S is 2, main scanning is executed twice on each raster line. Ordinarily, the dots are formed intermittently at every other dot positions for a single scan. In FIGS. 4(A) and 4(B), the scan repeat number S is 1, and the effective nozzle number Neff is a value obtained by dividing the working nozzle number N by the scan repeat number S. This effective nozzle number Neff can be thought of as the net number of raster lines on which dot recording are completed by a single main scan.

The table of FIG. 4(B) includes the sub-scan feed amount L for each pass, the summation ΣL thereof, and a nozzle offset F. The term "offset F" used herein is a value that expresses the separation of the nozzle positions in the sub-scan direction in units of dots relative to reference positions, taken as offset 0, which are periodic positions of the nozzles at the initial pass 1 (the position of every fourth dot in FIG. 4(A)). For example, as shown in FIG. 4(A), after pass 1, the position of the nozzles shifts by the sub-scan feed amount L (4 dots) in the sub-scan direction. On the other hand, the nozzle pitch k is 3 dots. Consequently, the offset F of the nozzles in pass 2 is 1 (FIG. 4(A)). Similarly, the positions of the nozzles on pass 3 have moved by ΣL=8 dots from the initial positions, and the offset F is 2 consequently. The positions of the nozzles on pass 4 have moved ΣL=12 dots from the initial positions, and the offset F is 0. Because the offset F of the nozzles returns to 0 on pass 4 after the third sub-scan feed, three sub-scans are considered to constitute one cycle of sub-scans. By repeating this cycle, all of the dots on the raster lines of the effective recording area can be recorded.

As is clear from the example of FIGS. 4(A) and 4(B), when the nozzle positions are separated from the initial positions by an integral multiple of the nozzle pitch k, the offset F is zero. In addition, the offset F is given by the remainder (ΣL)%k obtained by dividing the summation ΣL of the sub-scan feed amounts L by the nozzle pitch k. The operator "%" expresses the remainder of the division. The initial nozzle positions are considered periodic positions, and the offset F can be thought of as expressing the amount of positional shift from the initial positions of the nozzles.

If the scan repeat number S is 1, the following conditions are required so that there are no duplications or omissions in the recording of raster lines in the effective recording region:

Condition c1

The number of sub-scan feeds in one cycle of scan is equal to the nozzle pitch k.

Condition c2

The nozzle offset F after each sub-scan feed in one cycle assumes different values in the range of 0 to (k−1).

Condition c3

The average sub-scan feed amount (ΣL/k) in one cycle is equal to the working nozzle number N. In other words, the summation ΣL of the sub-scan feed amounts L in one cycle is equal to the value (N×k) obtained by multiplying the working nozzle number N and the nozzle pitch k.

The above conditions can be understood when envisioned in the following manner. Because there are (k−1) raster lines between adjacent nozzles, in order to return to the reference position of the nozzles position at which offset F=0) upon recording on these (k−1) raster lines in one cycle, the number of sub-feeds in one cycle must be k. If the number of sub-feeds in one cycle is less than k, there will be omissions in the recorded raster lines, and if the number of sub-scan feeds in one cycle is greater than k, there will be overlap in the recorded raster lines. The first condition c1 above is thus established.

When the number of sub-scans in one cycle is k, there will be no omissions or duplications in recorded raster lines when the offset value F after each sub-scan feed assumes different values within the range 0 to (k−1). The second condition c2 above is thus established.

If the first and second conditions above are satisfied, then k raster lines are recorded by the respective N nozzles during one cycle. Consequently, N×k raster lines are recorded during one cycle. On the other hand, if the third condition c3 is satisfied, then as shown in FIG. 4(A), the nozzle position after one cycle (after k number of sub-scan feeds) is separated by N×k raster lines from the initial nozzle position. Consequently, omissions or duplications in the recorded raster lines can be avoided in the range of these N×k raster lines if the first through third conditions c1 to c3 are satisfied.

Figures 5A, 5B:
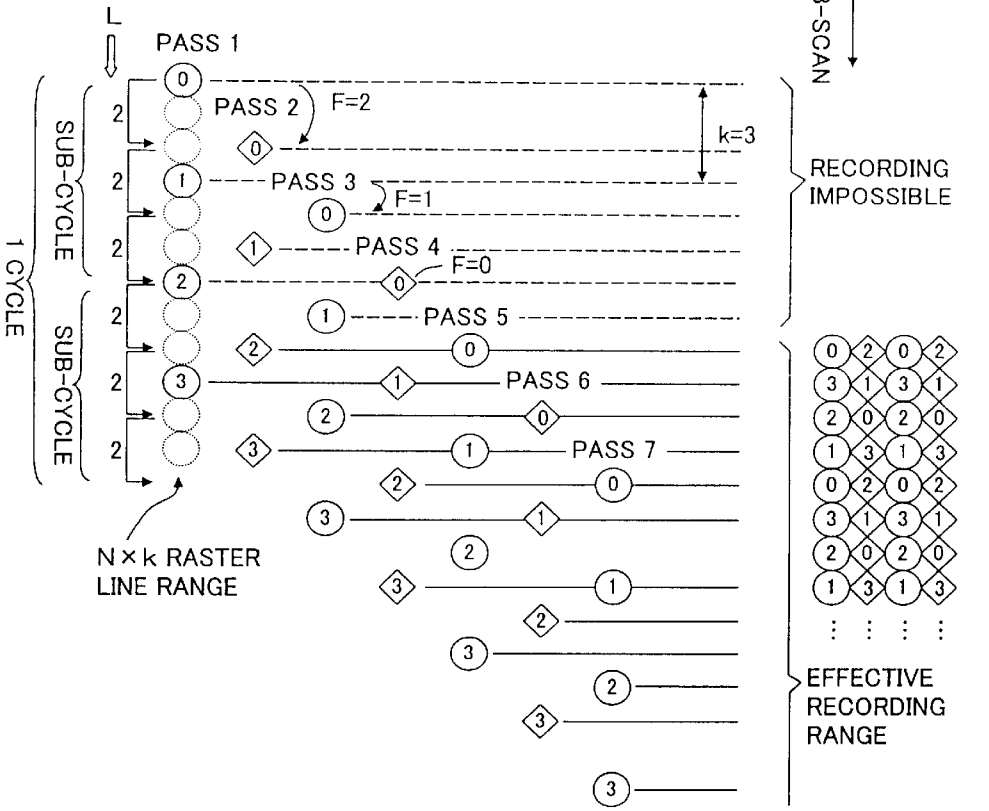
FIGS. 5(A) and (5)B are explanatory diagrams showing the basic conditions for overlap recording mode.

FIGS. 5(A) and 5(B) are explanatory diagrams showing the basic conditions for a dot recording mode where the scan repeat number S is 2 or greater. When the scan repeat number S is 2 or greater, main scanning is carried out s times on the same raster line. The dot recording mode with the scan repeat number S of 2 or greater is referred to as an "overlap mode".

The parameters of the dot recording mode shown in FIGS. 5(A) and 5(B) are different from that shown in FIG. 4(B) in the scan repeat number S and sub-scan feed amount L. As is clear from FIG. 5(A), the sub-scan feed amount L in the dot recording mode of FIGS. 5(A) and 5(B) is a constant value of 2 dots. The position of the nozzles on the even numbered passes is indicated by diamond shapes in FIG. 5(A). Ordinarily, as shown to the right in FIG. 5(A), the dot positions recorded on even number passes are shifted by one dot in the main scan direction relative to the dot positions recorded on odd number passes. Consequently, the dots on the raster line are recorded intermittently by two different nozzles. For example, the top-most raster line in the effective recording range is intermittently recorded at every other dot with nozzle #2 on pass 2, and is intermittently recorded at every other dot by nozzle #0 on pass 5. With this overlap mode, the nozzles are driven with intermittent timing in order to prevent recording of (S−1) dot after recording of one dot during the one main scan.

The overlap mode in which intermittent pixel positions on a raster line are subject to dot recording during each main scan pass is referred to as "intermittent overlap mode". All pixel positions, instead of intermittent pixel positions, on a raster line may be serviced during each main scan. Specifically, when S main scans are carried out on a single raster line, overlapping of dots on the same pixel position can be allowed. This type of overlap mode is referred to as "superimposed overlap mode" or "total overlap mode".

With the intermittent overlap mode, the positions on the same raster recorded by plural nozzles are shifted with respect to each other in the main scan direction, and so the shift amount in the main scan direction for each main scan can be conceived in various other ways in addition to that shown in FIG. 5(A). For example, the dot positions indicated by circles can be recorded on pass 2 without shifting in the main scanning direction, and dot positions indicated by the diamond shapes can be recorded on pass 5 by allowing a shift in the main scan direction.

The bottom-most row of the table of FIG. 5(B) shows the offset F for each pass in one cycle. One cycle includes six passes, and each value of the offset F in the range of 0–2 appears twice from pass 2 to pass 7. In addition, the change in offset F in the three passes from pass 2 to pass 4 is the same as the change in offset F in the three passes from pass 5 to pass 7. As shown at the left in FIG. 5(A), the six passes constituting one cycle can be divided into two sub-cycles, each including three passes. In this case, one cycle is completed by a repetition of s sub-cycles.

In general, when the scan repeat number S is a positive integer of 2 or greater, the first through third conditions c1–c3 indicated above are rewritten as c1'–c3' below.

Condition c1'

The number of sub-scan feeds in one cycle is equal to the value (k×S) obtained by multiplying the nozzle pitch k by the scan repeat number S.

Condition c2'

The nozzle offset F after each sub-scan feed in one cycle assumes respective values in the range of 0 to (k−1), s times each.

Condition c3'

The average sub-scan feed amount {ΣL/(k×S)} is equal to the effective nozzle number Neff (=N/S). In other words, the summation ΣL of the sub-scan feed amount L per cycle is equivalent to the value {Neff×(k×S)} obtained by multiplying the effective nozzle number Neff and the sub-scan feed repetitions (k×S).

Conditions c1'–c3' are applicable to a case where the scan repeat number S is 1. Consequently, the conditions c1'–c3' are generally applied to the dot recording modes, regardless of the scan repeat number S. Specifically, if the three conditions c1' to c3' are satisfied, then there are no unnecessary duplications or omissions in the recorded dots within the effective recording range. However, when an intermittent overlap mode is adopted, it is necessary to apply the condition that the recording positions of the nozzles that record the same raster line are shifted in the main scan direction with respect to each other. When the superimposed overlap mode is adopted, conditions c1' to c3' above should be satisfied, and all pixel positions are serviced in each pass.

C. Recording Mode Examples in the Embodiments

FIG. 6 is an explanatory diagram showing the scanning parameters of the first embodiment. This recording mode is an overlap mode in which the nozzle pitch k is 6 dots, the working nozzle number N is 48, the scan repeat number S is 2 and the effective nozzle number Neff is 24.

The table in FIG. 6 shows the parameters related to each of pass 1 to pass 13. The feed amount L (dots) for each of the 12 (=S×k) sub-scans that constitute one cycle is 20, 21, 22, 28, 27, 32, 32, 27, 28, 16, 15 and 20; plural different values are used here. As is indicated by the broken line between pass 7 and pass 8, the feed amounts of the 12 sub-scans constituting one cycle are divided into two groups each including 6 sub-scans. The two groups have different arrangements, or sequences, of sub-scan feed amounts.

The table of FIG. 6 also shows the summation ΣL of the sub-scan feed amounts L up to each pass, and the offset F. From these parameters, it is clear that the recording mode of the first embodiment satisfies the conditions c1' to c3' described above.

The pixel positions to be recorded in each pass are indicated at the bottom-most row of the table of FIG. 6. In this row, "0" denotes that the odd numbered pixel positions in this pass are to be recorded, and "1" denotes that the even numbered pixel positions are to be recorded. In the first embodiment, an intermitted overlap mode is adopted in which every other pixel positions are to be recorded intermittently.

The first embodiment can be used in bi-directional printing or uni-directional printing. In bi-directional printing, the even numbered passes are carried out in the forward direction, and the odd numbered passes are carried out in the reverse direction. In un-directional printing, each pass is always carried out in the forward direction. This situation is the same as for the other subsequent embodiments.

Figure 7:
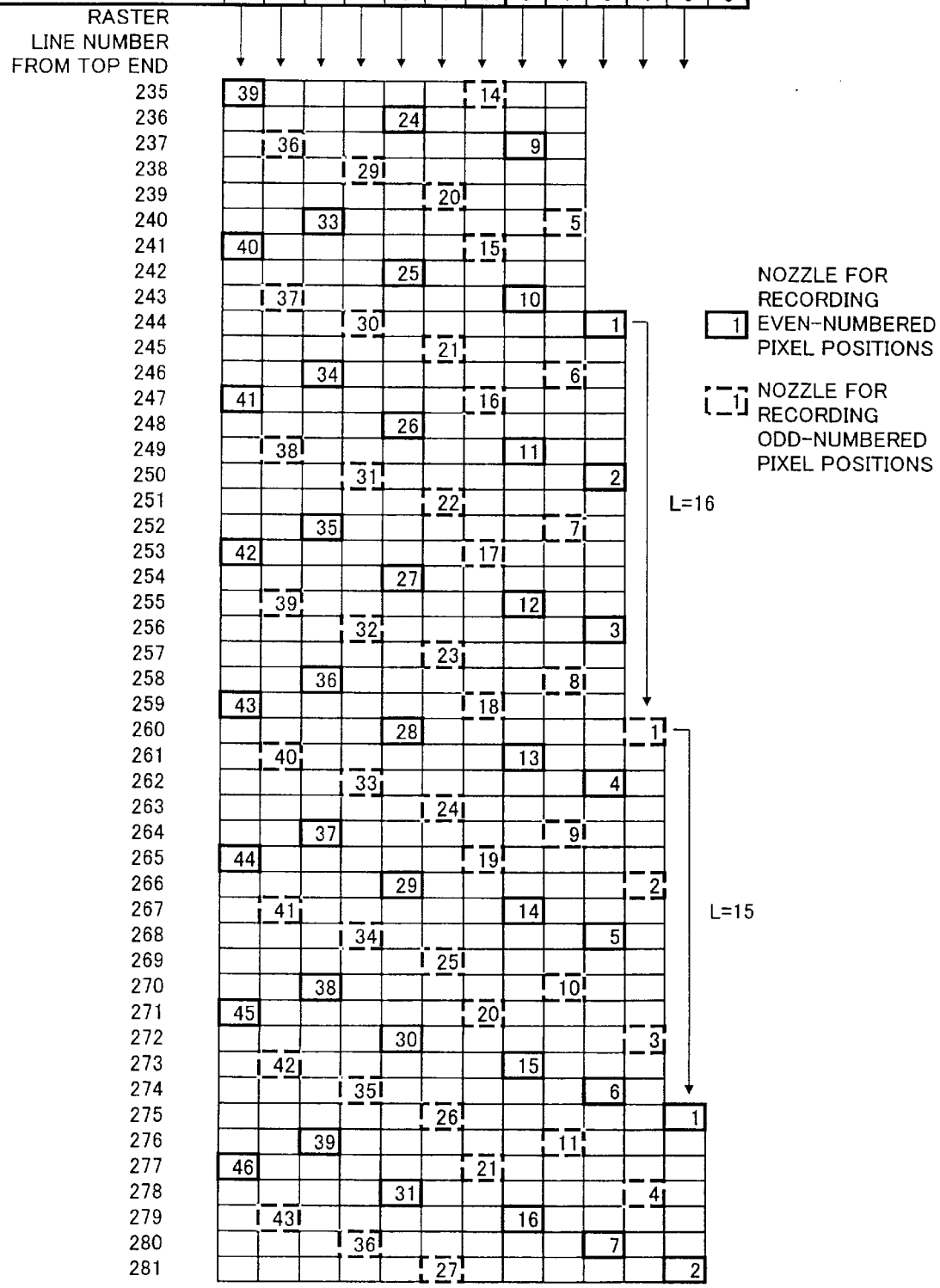
FIG. 7 is an explanatory diagram showing ordinal numbers of the nozzles that record respective raster lines on each pass in the first embodiment.

FIG. 7 shows the ordinal numbers of the nozzles that record raster lines in each pass in the first embodiment. The term "raster line number" shown at the left in FIG. 7 are ordinal numbers starting from the top-most end position at which the nozzles of the print head 36 are positioned; the top-most end position may be in a region where recording is not possible (FIG. 5(A)). The upper 234 raster lines are omitted to simplify the FIG., and only raster lines 235–275 are shown. The nozzles that record at odd numbered pixel positions are indicated by solid square boxes, and the nozzles that record at even numbered pixel positions are indicated by broken square boxes. It can be seen that recording of dots on each raster line is performed with two different nozzles; one nozzle for recording at odd numbered pixel positions and another nozzle for recording at even numbered pixel positions. For example, with the 244th raster line, the even numbered pixel positions are recorded by nozzle #30 in pass 4, and the odd numbered pixel positions are recorded by nozzle #1 in pass 0.

FIG. 8 is an explanatory diagram showing the scanning parameters of a comparative example. The recording mode of the comparative example is the same as that of the first embodiment, with the exception that the sub-scan feed amount sequence is different. In addition, among the feed amounts of the 12(=S×k) sub-scans constituting one cycle, the sequence of the former six sub-scan feed amounts for passes 2–7 is the same as that of the latter six sub-scan feed amounts for passes 8–13. The recording mode of the comparative example is an overlap mode that satisfies the aforementioned conditions c1' to c3'.

Figure 9:
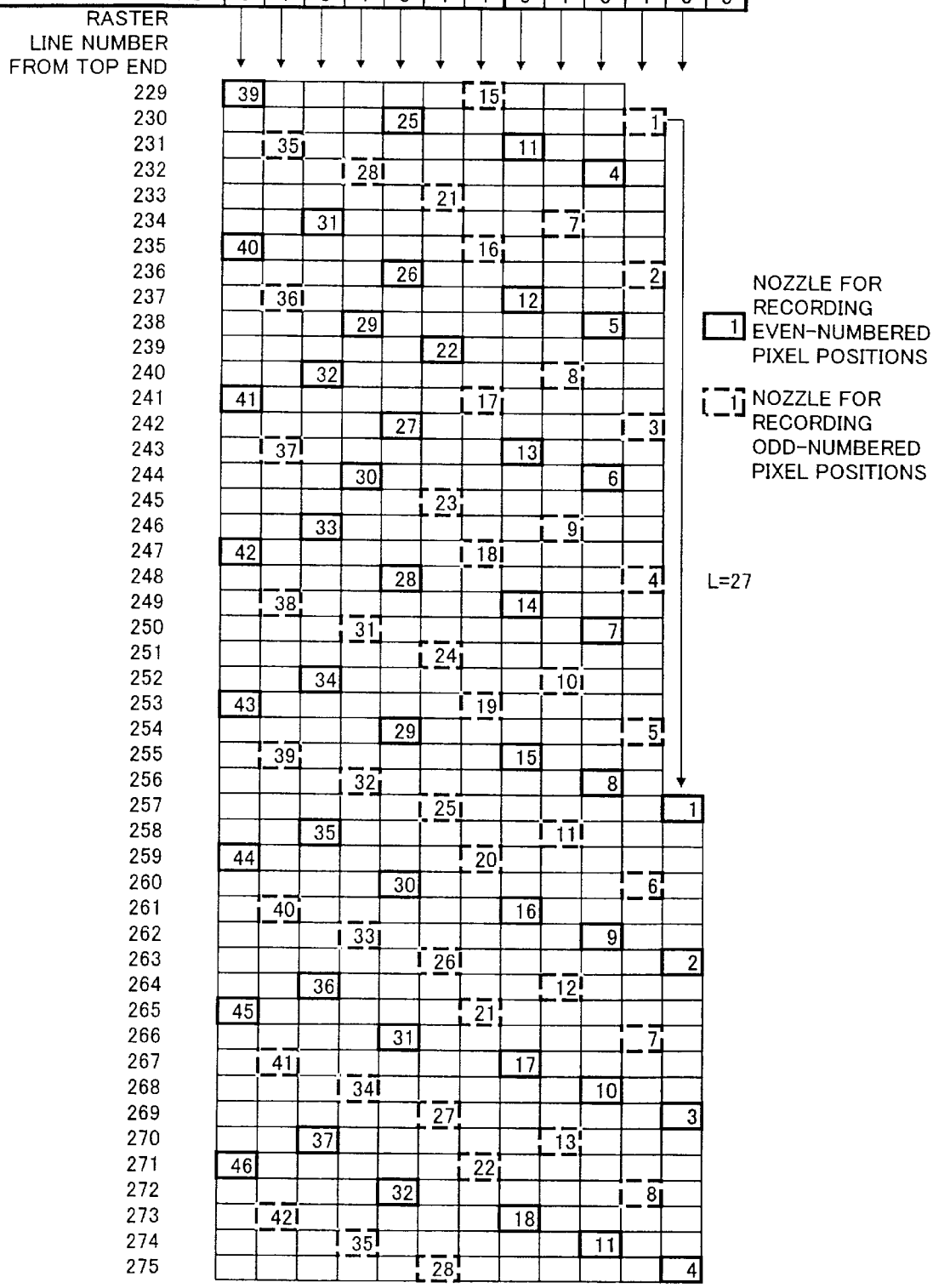
FIG. 9 is an explanatory diagram showing ordinal numbers of the nozzles that record respective raster lines on each pass in the comparative example.

FIG. 9 shows the ordinal numbers of the nozzles that record raster lines in each pass in the comparative example. In FIG. 9 as well, raster lines 229–275 are shown as in FIG. 7. In the comparative example, the combinations of nozzles that record dots on each raster line are fixed. For example, the nozzle that records the same raster line as nozzle #1 is always nozzle #25, and the nozzle that records on the same raster line as nozzle #2 is always nozzle #26. On the other hand, in the first embodiment shown in FIG. 7, there are three nozzles that record on the same raster line as nozzle #1: nozzle #30 (244th raster line), nozzle 28 (260th raster line) and nozzle 26 (275th raster line).

The combination of two nozzles that record the same raster line in an overlap mode when the scan repeat number S is 2 is referred to below as a "nozzle pair." The nozzle that constitutes a nozzle pair with a certain nozzle is referred to as the "partner nozzle." In the first embodiment shown in FIG. 7, a nozzle pair is formed by nozzle #1 and nozzle #30 that record on the 244th raster line. In addition, nozzle #28 and nozzle #26 are present in addition to nozzle #30 as partner nozzles that form a nozzle pair together with nozzle #1.

FIGS. 10(A) and 10(B) are explanatory diagrams showing the partner nozzles for nozzle #1 and upper- and lower-adjacent raster line recording nozzle each nozzle pair, pertaining to the first embodiment and comparative example. The term "upper-adjacent raster line recording nozzle" refers to the nozzle that is used for recording the raster line just above a particular raster line that is to be recorded by the nozzle pair. The term "lower-adjacent raster line recording nozzle" refers to the nozzle that is used for recording the raster line just below the particular raster line. For example, in FIG. 7, the 244th raster line is recorded by nozzle #1 and nozzle #30, and the upper adjacent raster line is recorded by nozzle #37 and nozzle #10. In this case, nozzle #30 is the partner nozzle for nozzle #1, and nozzle #37 and nozzle #10 are upper-adjacent raster line recording nozzles. In FIG. 10(A), nozzle #37 alone is indicated as an upper-adjacent raster line recording nozzle when nozzle #30 is the partner nozzle, and nozzle #10 is omitted. Although all of the partner nozzles are indicated in the table of FIGS. 10(A) and 10(B), some of the upper- and lower-adjacent raster line nozzles are omitted.

As shown in FIG. 10(A), 8 different nozzles are used as partner nozzles for nozzle #1 in the first embodiment. On the other hand, in the comparative example shown in FIG. 10(B), only nozzle #25 is used as the partner nozzle for nozzle #1. These conditions apply also to nozzles other than nozzle #1.

The nozzle pairs are fixed when the same sequence of feed amounts for k (=6) sub-scans is repeated S (=2) times, as in the comparative example. Because the nozzle pairs are always the same, image quality degradation can occur. Specifically, if the dot forming positions of the nozzle pair is shifted in opposite directions along the sub-scan direction relative to the ideal position (intended position), "banding" will occur in the vicinity of the raster line, resulting in the possibility of image quality degradation. On the other hand, if different sequences of sub-scan feed amounts are used for the two groups of k (=6) sub-scans, as in the first embodiment, then plural nozzles are used as the partner nozzle for each nozzle. In such a case, dot recording is carried out using various nozzle pairs, so that "banding" caused by manufacture differences in the nozzles mentioned above will not readily occur. Consequently, image quality degradation due to "banding" in overlap mode can be mitigated.

FIGS. 11(A)–11(C) are explanatory diagrams showing the scanning parameters for the second through fourth embodiments. The recording mode for the second through fourth embodiments are the same as in the first embodiment, with the exception that the sub-scan feed amount sequences are different. In addition, as is the case with the first embodiment, different sub-sequences are used for the sub-scan feed amounts for the first 6 passes 2–7, and the sub-scan feed amount sequence for the latter 6 passes 8–13 among the 12 (=S×k) sub-scans constituting one cycle.

FIGS. 12(A)–12(C) are explanatory diagrams presenting a comparison of the partner nozzle for nozzle #1, and the upper- and lower-adjacent raster line recording nozzles with respect to the second through fourth embodiments. In the second embodiment, six different nozzles are used as the partner nozzle with nozzle #1. In addition, in the third and fourth embodiments, eight different nozzles are used as the partner nozzle for nozzle #1 in the same manner as in the first embodiment shown in FIG. 10(A). Consequently, in the second through fourth embodiments as well, there is the advantage that image quality degradation due to banding can be mitigated in overlap mode in the same manner as in the first embodiment.

Which of the first through fourth embodiments attains the highest image quality depends on manufacture variation in each nozzle in the printing device. Consequently, the recording mode to be adopted can be determined based on a comparison of printing results obtained by printing the same test image with the four different recording modes using the scanning parameters of the first through fourth embodiments, which are stored in advance in the memory (not shown) of the system controller (FIG. 2).

FIG. 13 is an explanatory diagram showing the scanning parameters for the fifth embodiment. The recording mode for the fifth embodiment is the same as that for the first through fourth embodiments, with the exception that the sub-scanning feed amount sequence is different. In addition, as is the case with the first through fourth embodiments, different sub-sequences are used for the sub-scan feed amounts for the first 6 passes 2–7, and the sub-scan feed amounts for the latter 6 passes 8–13 among the 12 (=S×k) sub-scans constituting one cycle.

The fifth embodiment is different from the first through fourth embodiments in the range of the feed amount value. Specifically, a feed amount in the range of 8–62 dots is used for the fifth embodiment, whereas a feed amount range of 15–32 dots (first and second embodiments) or a feed amount range of 14–32 dots (third and fourth embodiments) is used for the first through fourth embodiments.

The advantage of the fifth embodiment is as follows. In general, when banding occurs for any reason, the banding occurrence period tends to depend on the sub-scan feed amounts. Specifically, the banding occurrence period increases with increasing sub-scan feed amount, and decreases with decreasing sub-scan feed amount. Consequently, when the sub-scan feed amount is maintained within a comparatively narrow range as in the first through fourth embodiments, the banding occurrence period will be in a comparatively narrow range regardless of the cause of banding. When the banding occurrence period is within a comparatively narrow range in this manner, it is easy to detect with the naked eye, and tends to degrade image quality. On the other hand, when the sub-scan feed amount occurs over a comparatively broad range, as in the fifth embodiment, the banding occurrence period will also be distributed over a comparatively wide range, so that banding is not readily detected by the naked eye, which can mitigate image degradation.

As shown in the fifth embodiment, when a comparatively broad range of values are used for the sub-scan feed amount, it is preferable for the ratio of the largest value and smallest value to be about 4 or greater . In the fifth embodiment, the ratio of the largest value and smallest value is about 8 (62/8), whereas the ratio in the first through fourth embodiments is about 2 (32/15).

FIG. 14 is an explanatory diagram showing a comparison of the partner nozzles for nozzle #1 and the upper- and lower-adjacent raster line recording nozzles in the fifth embodiment. In the fifth embodiment, 11 different nozzles are used for the partner nozzle for nozzle #1. Specifically, more nozzle pairs are used in the fifth embodiment than in the first through fourth embodiments, which is preferable from the standpoint of mitigating image quality degradation due to the banding.

Figures 15A, 15B:
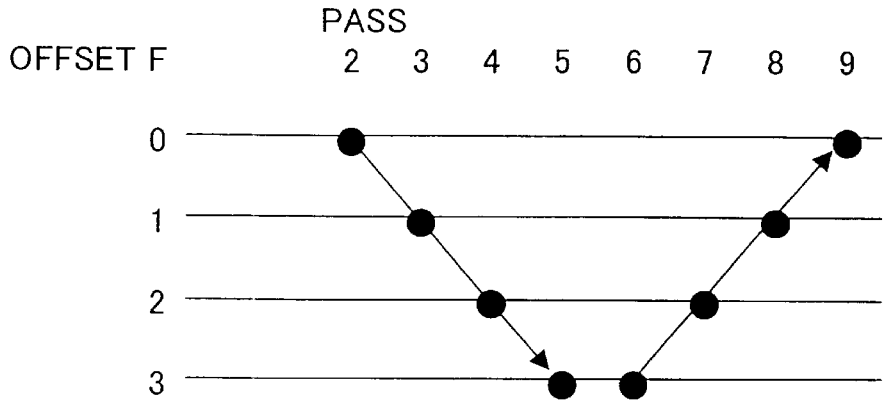
FIGS. 15(A) and 15(B) are explanatory diagrams showing the scanning parameters for the sixth embodiment.
Figure 16:
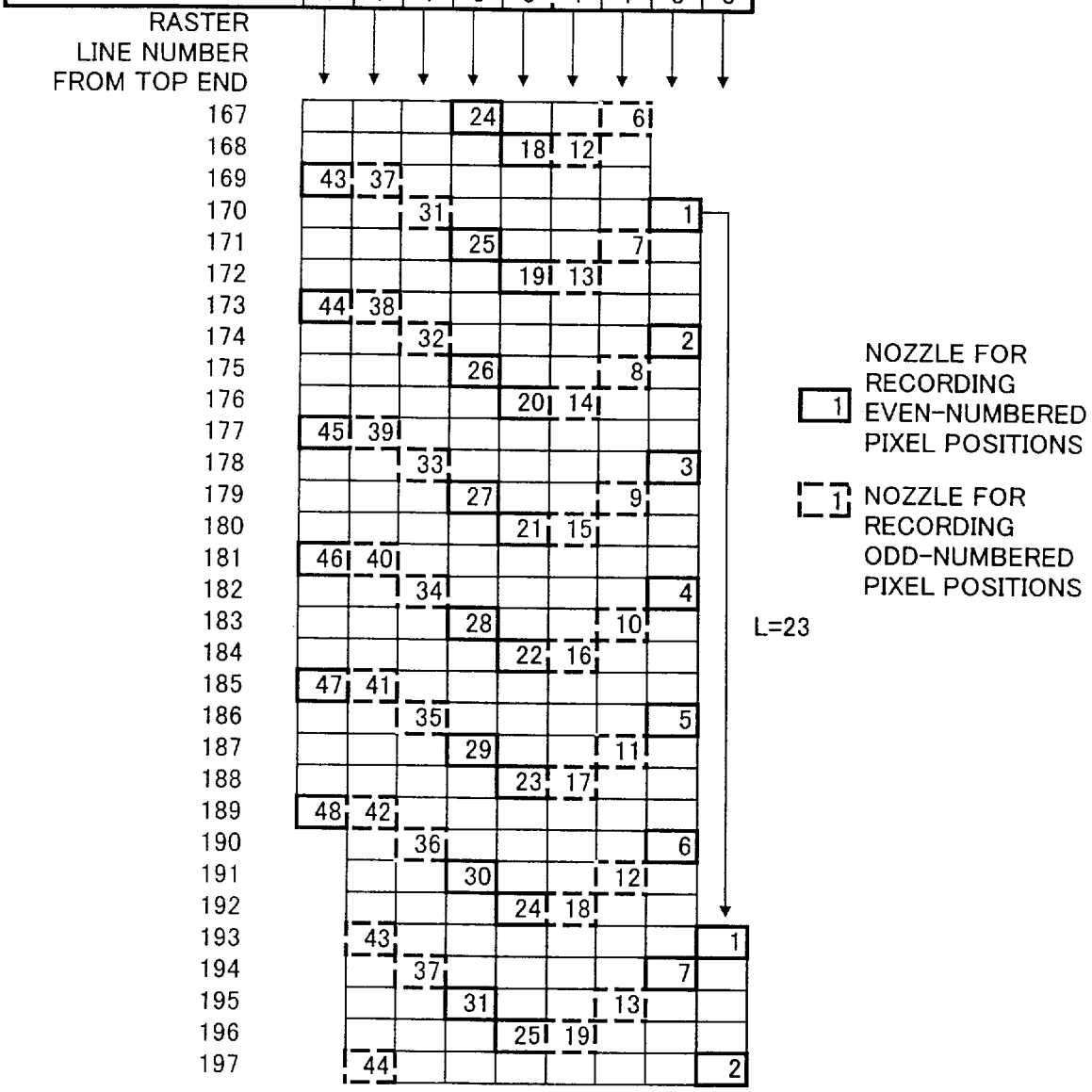
FIG. 16 is an explanatory diagram showing ordinal numbers of the nozzles that record respective raster lines on each pass in the sixth embodiment.

FIGS. 15(A) and 15(B) are explanatory diagrams showing the scanning parameters for the sixth embodiment. FIG. 16 is an explanatory diagram showing the ordinal numbers of the nozzles that record raster lines in each pass in the sixth embodiment. As shown in FIG. 15(A), this recording mode is an overlap mode wherein the nozzle pitch k is 4 dots, the working nozzle number N is 48, the scan repeat number S is 2, and the effective nozzle number Neff is 24. In this recording mode as well, the sub-scan feed amount sequence for the first 4 passes 2–5 is different from that for the latter 4 passes 6–9 among the 8 (=S×k) sub-scans constituting one cycle. Consequently, although not shown in the figure, numerous nozzle pairs are used in the sixth embodiment in the same manner as in the first through fifth embodiments, and image quality degradation due to the banding is thus mitigated.

The recording mode of the sixth embodiment is also characterized by having a modification pattern for the offset F shown in FIG. 15(B). In the sixth embodiment, the value of the offset F is increased by 1 {0, 1, 2, 3}, and is then decreased by 1 {3, 2, 1, 0}. Specifically, in the first half of the cycle and the second half of the cycle, the sub-scan feed amount sequence is not only different, but the offset F arrangement is also different. This stands in contrast to the offset F in the first through fifth embodiments above, where a constant sequence {2, 5, 3, 1, 4, 0} of the offset F is repeated.

When this offset F sequence is adopted, it is possible to decrease cumulative errors in sub-scan feed. For example, a sub-scan feed mechanism can be conceived wherein the cumulative error in sub-scan feed increases with increasing value of the offset F, and decreases with decreasing value of the offset F. When this type of mechanism is used, the cumulative sub-scan feed error increases from passes 2–5 in FIG. 15(B), but decreases in passes 6–9. As a result, it is possible to further reduce banding.

Figures 17A, 17B:
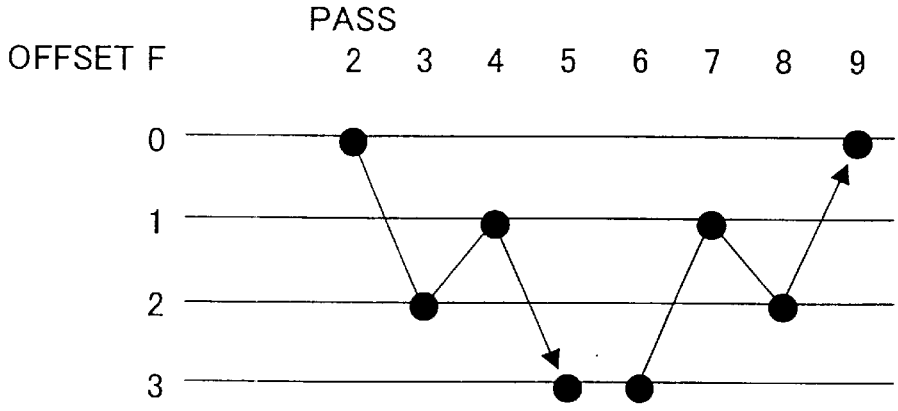
FIGS. 17(A) and, 17(B) are explanatory diagrams showing the scanning parameters for the seventh embodiment.
Figure 18:
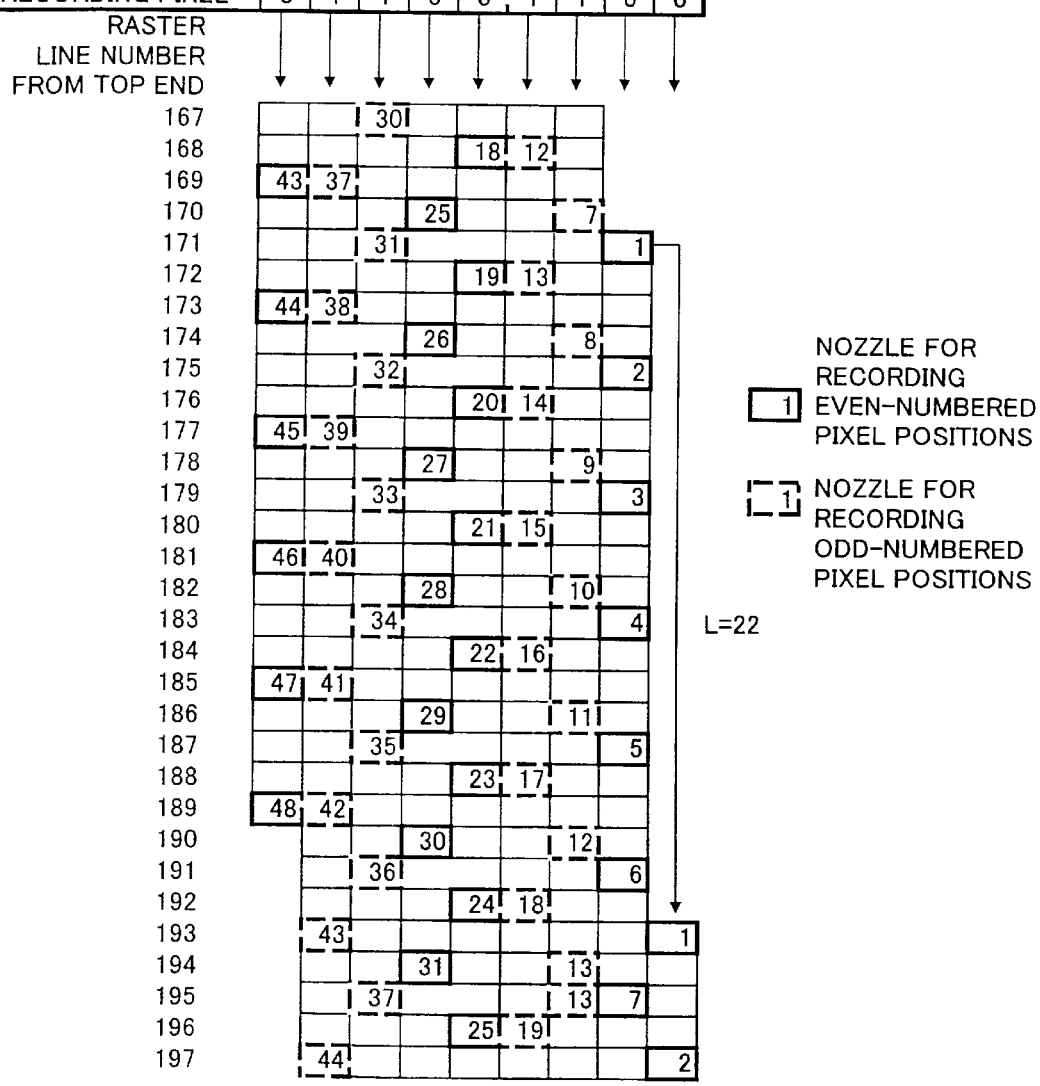
FIG. 18 is an explanatory diagram showing ordinal numbers of the nozzles that record respective raster lines on each pass in the seventh embodiment.

FIGS. 17(A) and 17(B) are explanatory diagrams of the scanning parameters for the seventh embodiment. FIG. 18 is an explanatory diagram showing the ordinal numbers of the nozzles that record raster lines in each pass in the seventh embodiment. As shown in FIG. 17(A), the recording mode is different from that of the sixth embodiment shown in FIG. 15(A) only in the sub-scan feed amounts. This recording mode also has the same fundamental characteristic in that the sub-scan feed amount sequence for the first four passes 2–5 is different from that for the latter four passes 6–9 among the 8 (=S×k) sub-scans constituting one cycle. In addition, this mode has the second characteristic that the sequence of the offset F is different between the first half and the second half of one cycle. Consequently, the seventh embodiment can mitigate image degradation due to the banding in the same manner as in the sixth embodiment described above.

As can be seen from a comparison of FIG. 15(B) and FIG. 17(B), the pattern of the offset F is reversed in the first half and second half of one cycle in the sixth and seventh embodiments, so that the patterns for the first half and second half are symmetrical. The sequence of the offset F need not be reversed in the second half relative to the first half, but it is preferable for the sub-scan feed amounts be established so that the sequence of the offset F is different in the first half and second half. However, when the sequences of the offset F are reversed, the effect of decreasing banding due to cumulative error in sub-scan feeding described above can be further enhanced.

The influence of cumulative sub-scan feed error on banding tends to increase when pigment ink is used relative to when dye ink is used. The suspected reason is that pigment ink does not spread very much on the surface of the paper, so that gaps between raster lines resulting from sub-scan feed errors are more readily produced. Consequently, the merit of an offset F arrangement of the type described in the sixth and seventh embodiments is particularly remarkable with printing devices that employ pigment ink.

D. Modifications

The present invention is not restricted to the above embodiments and modes of implementation, and can be implemented in various configurations within a scope that does not exceed the gist of the invention. For example, the following modifications are possible.

D1. Modification 1

In each of the above embodiments, the scan repeat number S is 2, but the present invention can be utilized in cases where the scan repeat number S is any integer of 2 or greater. In addition, the present invention can be used in cases where the nozzle pitch k [dots] is any integer of 2 or greater. In such a case, the feed amounts of the S×k sub-scans are divided into S groups each including k feed amounts for consecutive k sub-scans, and at least one of the S groups of sub-scans has a different sequence of feed amounts from those of the other groups.

In addition, regarding the offset F arrangement, it is preferable for the sub-scan feed amounts to be established so that the offset F arrangement for at least one of the S groups of sub-scans has a different arrangement from those of the other groups, and it is particularly desirable for the offset F arrangement to be reversed from those for its adjacent groups.

D2. Modification 2

In the various embodiments described above, an intermittent overlap mode is adopted, but it is also possible to use a complete overlap mode where all of the pixel positions on the main scan lines that are scanned can be serviced in each pass.

Ordinarily, banding occurring as a result of a combination of nozzles tends to increase in intermittent overlap mode, and thus the effects are particularly dramatic when the present invention is used in intermittent overlap mode.

D3. Modification 3

The present invention can also be adopted for drum scanning type printers. With drum scanning type printers, the direction of drum rotation is the main scan direction, and the direction of carriage travel is the sub-scan direction. The present invention can be used not only with ink jet printers, but with printing devices in which printing onto the surface of a printing medium is carried out using a print head having multiple nozzles. These types of printing devices include facsimile devices and copy devices.

D4. Modification 4

In the embodiments described above, part of the configuration that is realized in hardware can be converted into software, and conversely, part of the configuration that is realized in software can be converted into hardware. For example, some of the functions of the system controller 54 (FIG. 2) can be implemented by the host computer 100.

Computer programs that perform this type of function are offered in various types of computer readable recording media such as floppy disks and CD-ROMs. The host computer 100 reads the computer program from the recording medium, and transmits it to an internal memory device or external memory device. Alternatively, the computer program can be supplied to the host computer 100 from a program supply device via a communication path. When the function of the computer program is executed, the computer program that has been stored in the internal memory device is executed by the microprocessor of the host computer 100. In addition, the computer program that has been stored on the storage medium can be directly executed by the host computer 100.

In this specification, the host computer 100 is a general term that includes a hardware device and operation system, and refers to a hardware device that is operated under the control of the operating system. The computer program executes various parts of the aforementioned functions in this host computer 100. Some of the above functions can also be executed by the operating system without using an application program.

In the present invention, the term "computer readable recording medium" is not restricted to a portable recording medium such as a flexible disk or CD-ROM, and also includes internal storage devices in the computer such as RAM and ROM, as well as external storage devices attached to the computer, such as hard disks.

INDUSTRIAL APPLICABILITY

The present invention can be employed in printers or facsimile devices that discharge in from nozzles.

What is claimed is:

1. A printing device for carrying out printing on a printing medium during main scanning, comprising:

a print head having one or more nozzle arrays each including a plurality of nozzles for forming dots of same color;

a main scan drive section that carries out main scanning by moving at least either of the printing medium and print head;

a sub-scan drive section that carries out sub-scanning by moving at least either of the printing medium and the print head;

a head drive section that carries out dot formation by driving at least some of the plurality of nozzles during main scan; and a controller for controlling printing operations;

wherein the plurality of nozzles for forming dots of the same color have a constant nozzle pitch k×D in the sub-scan direction, where k is an integer of 2 or greater and D is a dot pitch that corresponds to a printing resolution in the sub-scan direction; and the controller carries out the control such that:

each main scan line is scanned S times, where S is an integer of 2 or greater, using different nozzles;

a combination of different values is used as feed amounts for S×k sub-scans; and when the feed amounts for the S×k sub-scans are divided into S groups each containing k feed amounts for consecutive k sub-scans, a sequence of sub-scan feed amounts in at least one of the S groups of sub-scans is different from sequences in the other groups.

2. A printing device according to claim 1, wherein intermittent pixel positions at a ratio of 1 to S pixels on a main scan line are serviced for dot formation in each of S main scans performed on the main scan line, and all of the pixel positions on the main scan line are serviced for dot formation by the S main scans.

3. A printing device according to claim 1, wherein a ratio of the largest and smallest values of the S×k sub-scan feed amounts is set at about 4 or greater.

4. A printing device according to claim 1, wherein when a offset F is defined as a remainder obtained by dividing a cumulative value of sub-scan feed amounts by the integer k, a sequence of the offset F for at least one of the S groups of sub-scan feed amounts is different from sequences for the other groups.

5. A printing device according to claim 4, wherein the sequence of the offset F for each group of sub-scan feed amounts is reversed from the sequence of the offset F for adjacent groups.

6. A printing device according to claim 4, wherein the print head forms dots using pigment ink.

7. A printing method for carrying out printing on a printing medium during main scanning using a printing device, the printing device comprising a print head having one or more nozzle arrays each including a plurality of nozzles for forming dots of same color, the printing method comprising the steps of:

(a) carrying out main scanning by moving at least either of the printing medium and print head, and carrying out dot formation by driving at least some of the plurality of nozzles during main scan; and (b) carrying out sub-scanning by moving at least either of the printing medium and the print head;

wherein the plurality of nozzles for forming dots of the same color have a constant nozzle pitch k'D in the sub-scan direction, where k is an integer of 2 or greater and D is a dot pitch that corresponds to a printing resolution in the sub-scan direction, each main scan line is scanned S times, where S is an integer of 2 or greater, using different nozzles, a combination of different values is used as feed amounts for S×k sub-scans, and when the feed amounts for the S×k sub-scans are divided into S groups each containing k feed amounts for consecutive k sub-scans, a sequence of sub-scan feed amounts in at least one of the S groups of sub-scans is different from sequences in the other groups.

8. A printing method according to claim 7, wherein intermittent pixel positions at a ratio of 1 to S pixels on a main scan line are serviced for dot formation in each of S main scans performed on the main scan line, and all of the pixel positions on the main scan line are serviced for dot formation by the S main scans.

9. A printing method according to claim 7, wherein a ratio of the largest and smallest values of the S×k sub-scan feed amounts is set at about 4 or greater.

10. A printing device according to claim 7, wherein when a offset F is defined as a remainder obtained by dividing a cumulative value of sub-scan feed amounts by the integer k, a sequence of the offset F for at least one of the S groups of sub-scan feed amounts is different from sequences for the other groups.

11. A printing method according to claim 10, wherein the sequence of the offset F for each group of sub-scan feed amounts is reversed from the sequence of the offset F for adjacent groups.

12. A printing method according to claim 10, wherein the print head forms dots using pigment ink.

13. A computer program product for causing a computer including a printing device to carry out printing on a printing medium during main scanning, the printing device comprising a print head having one or more nozzle arrays each including a plurality of nozzles for forming dots of same color, the computer program product comprising:

a computer readable medium; and a computer program stored on the computer readable medium, wherein the plurality of nozzles for forming dots of the same color have a constant nozzle pitch k×D in the sub-scan direction, where k is an integer of 2 or greater and D is a dot pitch that corresponds to a printing resolution in the sub-scan direction, and the computer program including a computer program for causing the computer to effect printing such that:

each main scan line is scanned S times, where S is an integer of 2 or greater, using different nozzles, a combination of different values is used as feed amounts for S×k sub-scans, and when the feed amounts for the S×k sub-scans are divided into S groups each containing k feed amounts for consecutive k sub-scans, a sequence of sub-scan feed amounts in at least one of the S groups of sub-scans is different from sequences in the other groups.

14. A computer program product according to claim 13, wherein intermittent pixel positions at a ratio of 1 to S pixels on a main scan line are serviced for dot formation in each of S main scans performed on the main scan line, and all of the pixel positions on the main scan line are serviced for dot formation by the S main scans.

15. A computer program product according to claim 13, wherein a ratio of the largest and smallest values of the S×k sub-scan feed amounts is set at about 4 or greater.

16. A computer program product according to claim 13, wherein when a offset F is defined as a remainder obtained by dividing a cumulative value of sub-scan feed amounts by the integer k, a sequence of the offset F for at least one of the S groups of sub-scan feed amounts is different from sequences for the other groups.

17. A computer program product according to claim 16, wherein the sequence of the offset F for each group of sub-scan feed amounts is reversed from the sequence of the offset F for adjacent groups.

18. A computer program product according to claim 16, wherein the print head forms dots using pigment ink.

* * * * *